United States Patent [19]

Shimada

[11] 3,982,685

[45] Sept. 28, 1976

[54] METHOD AND DEVICE FOR SEPARATING CARTON LAYERS TO OPEN A CLOSED TYPE CARTON CONTAINER

[75] Inventor: Yoshiji Shimada, Kobe, Japan

[73] Assignee: Kinki Printing Company Limited, Osaka, Japan

[22] Filed: Sept. 2, 1975

[21] Appl. No.: 609,330

[52] U.S. Cl. ..... 229/51 TS; 206/233; 206/494; 206/498; 229/51 D; 221/45

[51] Int. Cl.[2] ..... B65D 5/54; B65D 5/72

[58] Field of Search ..... 229/51 TS, 51 D, 7 R; 206/233, 494, 498; 221/45–48

[56] References Cited

UNITED STATES PATENTS

| | | | |
|---|---|---|---|
| 2,953,293 | 9/1960 | Anderson | 229/51 TS |
| 3,019,944 | 2/1962 | Nelson et al. | 229/51 TS |
| 3,021,002 | 2/1962 | Guyer | 206/494 |
| 3,043,472 | 7/1962 | Nemoede | 229/51 TS |
| 3,185,578 | 5/1965 | Scharre | 229/51 D |
| 3,186,623 | 6/1965 | Guyer | 229/51 TS |
| 3,502,257 | 3/1970 | Virros | 229/51 TS |
| 3,727,750 | 4/1973 | Petter | 229/51 TS |
| 3,854,652 | 12/1974 | Brackmann | 229/51 TS |

*Primary Examiner*—William T. Dixson, Jr.
*Assistant Examiner*—Bruce H. Bernstein
*Attorney, Agent, or Firm*—Frank J. Jordan

[57] ABSTRACT

A wider and a narrower surface and back half-cut lines are provided adjacent to each other on a wall of a closed carton or container. Carton layers are separated from each other at the surface and back half-cut lines to thereby open the container. When the container is in a closed state, there is no perforated point passing all the way through the wall from the surface to the back or vice versa. Thus, moisture from the outside is prevented from passing into the inside of the container, and yet it is very easy to open the container.

5 Claims, 6 Drawing Figures

METHOD AND DEVICE FOR SEPARATING CARTON LAYERS TO OPEN A CLOSED TYPE CARTON CONTAINER

A first object of this invention is to provide a closed type carton container which is easily opened by simply pulling a smaller lid and pushing a larger lid with the fingers.

A second object of this invention is to provide a closed type or container which contains half-cut portions forming orderly lines by the presence of half-cuts from the back and from the surface of one wall respectively, and which can thereby can be readily used with ease after the lids have been opened.

A third object of this invention is to provide a closed type carton container allowing no air or moisture to enter from the outside by being provided with half-cut lines from the back and from the surface of the wall respectively, and not passing through the wall from the surface to the back or vice versa.

A fourth object of this invention is to provide a tissue paper container which allows pieces of tissue paper to be orderly taken out one by one without being a massive form.

In a conventional container for tissue paper, an elliptical perforated line or the like is provided on the top wall of the container. A portion surrounded by the perforated line is torn off at the line to open the container. However, this known arrangement has the following disadvantage. When a little pressure is applied to the container when, for example, it is being transported, the perforated portion may be accidentally torn off.

To remove such a disadvantage, it has been proposed to make the distance between one cut point and the next cut point of the perforated line longer. However, the container with such an arrangement has another disadvantage. It is very difficult to tear off the portion at the perforated line when one wants to open the container. Moreover when one tries to tear it off forcibly, one may tear it off in a direction other than along the perforated line.

What is more, when the container is provided with the perforated line with each cut point going all the way through from the surface to the back of its top wall, moisture from the outside may penetrate into the inside of the container through the cut points and result in adverse influence on its contents.

The container of this invention has none of such disadvantages. In opening the container, a more or less half moon shaped portion surrounded by a fold connecting two points where a surface, half-cut line and a linear back, half-cut line overlaps and by a smaller back, half-cut line, is pushed with the fingers towards the inside of the container. Then the half moon shaped portion is readily separated from the wall. By picking grasping and raising the separated portion, the remaining part of the surface, half-cut line is separated from a larger, half-cut line to attain the desired purpose of opening the container quite easily. The opening is an orderly one, and no irregular break is made.

Besides, as has been previously stated, all of the cut lines are only half cut and not cut all the way through from the surface to the back of the top wall, and so there is no danger of the cut lines being broken by outside force when the container is being transported.

What is more, when the opening of a container has a slender form, and when the container is used for tissue paper, there is no need of providing the container with a paper weight, and yet the tissue paper can be orderly taken out one by one through the slender opening.

Figure 1:
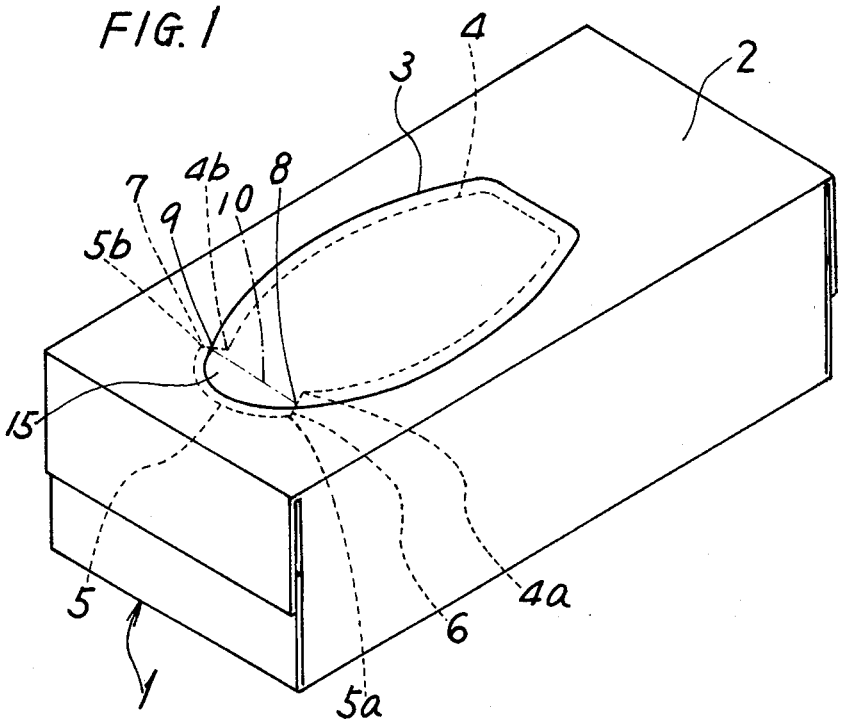
FIG. 1 is a perspective view of an entire container when it is closed according to one embodiment of the present invention.
Figure 2:
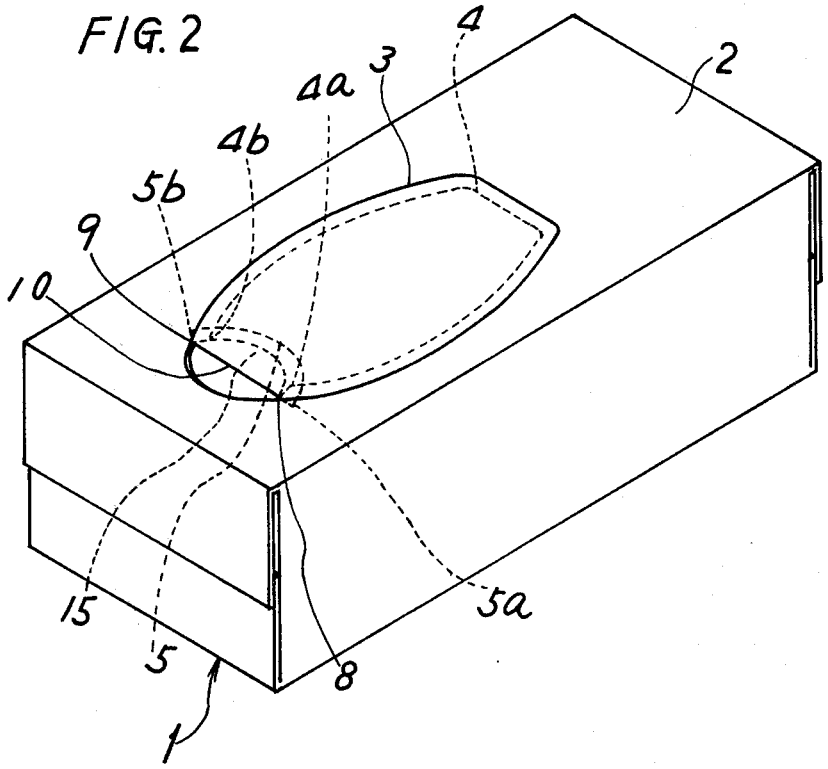
FIG. 2 is a perspective view of the container after its opening has been started.
Figure 3:
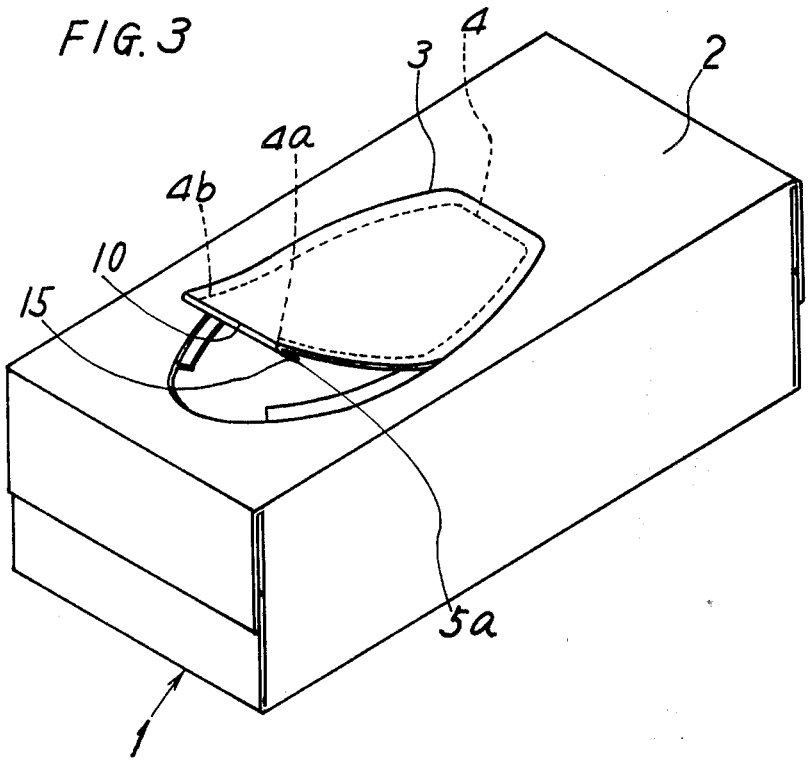
FIG. 3 is a perspective view of the entire container after it has been half opened.
Figure 4:
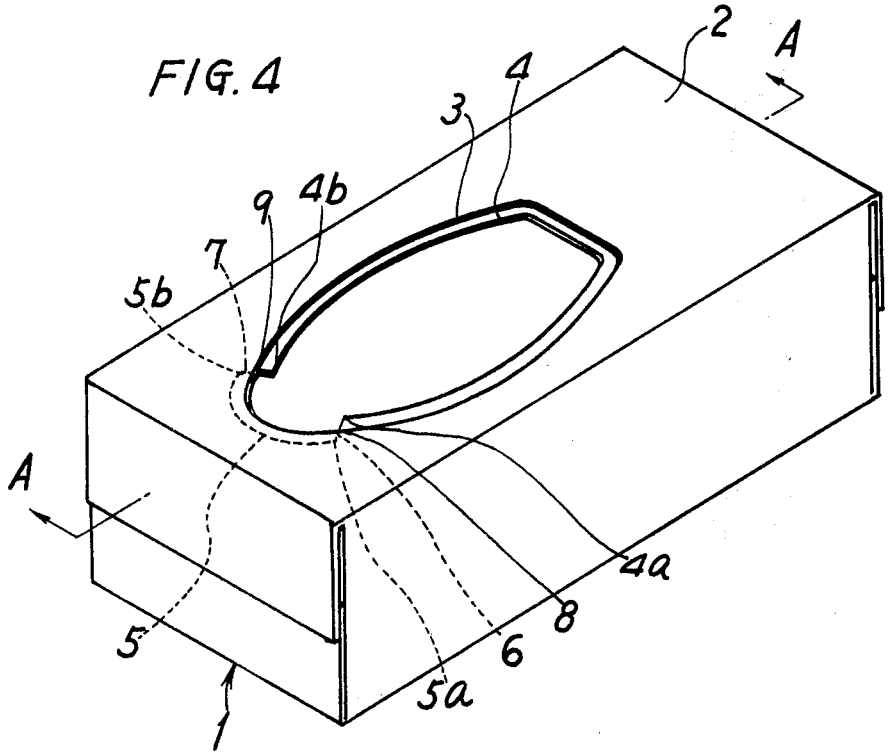
FIG. 4 is a perspective view of the entire container after it has been completely opened.
Figure 5:
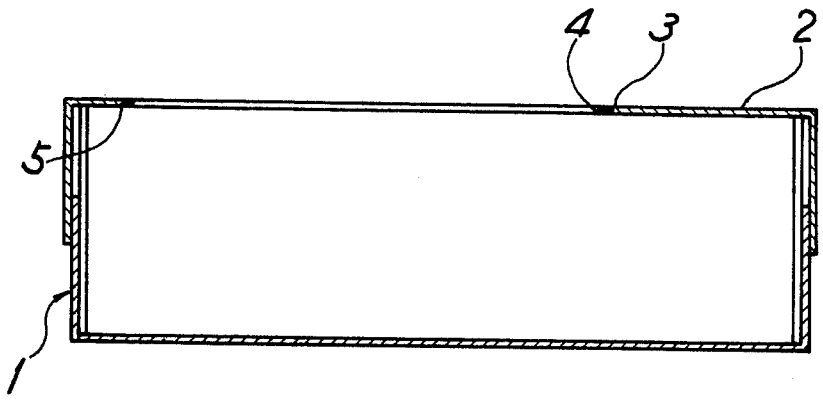
FIG. 5 is a sectional view taken along line A — A in FIG. 4.
Figure 6:
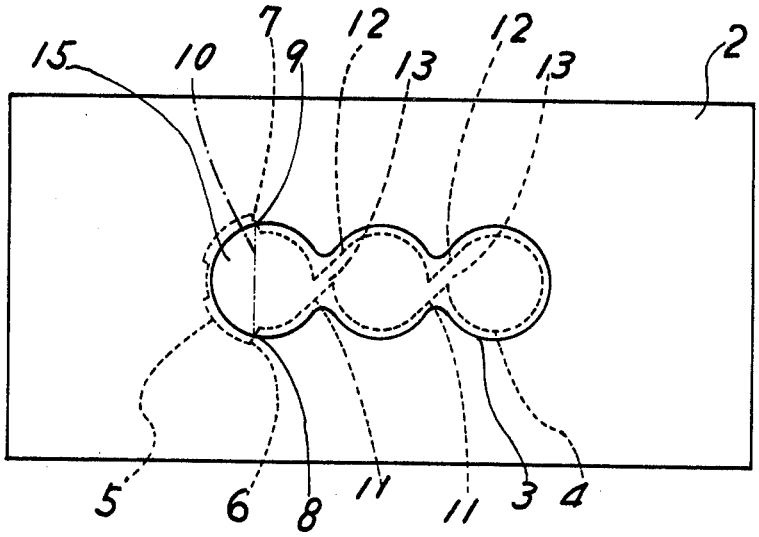
FIG. 6 is a plan view of essential parts of an alternate embodiment showing a closed container having an elongated opening.

An embodiment of the invention is illustrated with reference to the accompanying drawings. The numeral 1 represents a closed type carton. The numeral 2 represents a top wall of the carton 1. The numeral 3 represents a circular surface half-cut line provided in any place on the surface of the top wall 2, the line 3 being half cut from the surface and not being cut all the way through from the surface to the back of the top wall 2. The numeral 4 represents a larger back half-cut line provided along the inside of most of the circular half-cut line 3, the line 4 being half cut from the back, and not being cut all the way through from the back to the surface. The numeral 5 represents a smaller back half-cut line provided along the outside of the remaining part of the surface half-cut line 3, such remaining part being a part along which no larger back half-cut line is provided. The numerals 4 *a* and 4 *b* represent both ends of the larger back half-cut line 4. The numerals 5 *a* and 5 *b* represent both ends of the smaller back half-cut line. The numeral 6 represents a linear back half-cut line provided along the line connecting the ends 4 *a* and 5 *a*. The numeral 7 represents a linear back half-cut line provided along the line connecting the ends 4 *b* and 5 *b*. The numeral 8 represents a point where the linear back half-cut line 6 and the surface half-cut line 3 overlap. The numeral 9 represents a point where the linear back half-cut line 7 and the surface half-cut line 3 overlap. The numeral 10 represents a fold provided along the line connecting the overlapped points 8 and 9. The numerals 11 and 12 in FIG. 6 represent parts of the larger back half-cut line 4. The numeral 13 represents a slender space between the parts 11 and 12. The space 13 is made particularly slender to prevent all of the tissue paper from coming out of a container. Thus, the slender space 13 makes it unnecessary for the container to be provided with a paper weight.

This invention has such a construction as has been described above. In opening a container, it is only necessary to push a more or less half moon-shaped portion 15, surrounded by the fold 10 and by the smaller back half-cut line 5, towards the inside of the container. Then the surface half-cut line is separated from the smaller back half-cut line 5 with the half moon-shaped portion turned in. Then it is only necessary to fold the said fold 10 twice and grasp it with the fingers and raise it upwardly. Then the surface half-cut line 3 is easily separated from the larger back half-cut line to open the container.

What we claim is:

1. A dispensing carton having walls defining a hollow enclosure, one of said walls being paperboard and having a first cut line cut from the outside and extending partially through the paperboard, said first cut line extending as a closed loop, a second cut line cut from the inside and extending partially through the paperboard, said second cut line having an open generally loop-like configuration with opposed terminating ends, said second cut line being spaced radially inwardly of a portion of said first cut line, a third cut line cut from the inside and extending partially through the paperboard, said third cut line having an open generally loop-like configuration with opposed terminating ends, said third cut line being spaced radially outwardly of another portion of said first cut line, a pair of generally linear cut lines cut from the inside and partially extending through the paperboard, each of said pair of generally linear cut lines connecting said terminating ends of said second and third cut lines respectively, and a fold line connecting the points where said first cut line overlaps said linear cut lines.

2. A dispensing carton according to claim 1 wherein the loop-like configuration defined by said third cut line is adapted to be folded inwardly about said fold line and doubled back on itself to form a tab element adapted to be grasped.

3. A dispensing carton according to claim 1 wherein said second cut line is larger than said third cut line.

4. A dispensing carton according to claim 1 wherein the loop-like configuration defined by said first cut line is generally of a slender shape to provide a dispensing opening for the carton.

5. A dispensing carton according to claim 1 wherein the longitudinal end of said fold line intersects said linear cut lines at an intermediate position of each linear cut line.

* * * * *